US010386145B2

(12) United States Patent
Golan

(10) Patent No.: US 10,386,145 B2
(45) Date of Patent: Aug. 20, 2019

(54) DOUBLE BARREL ADJUSTMENT ASSEMBLY

(71) Applicant: SILVER SHADOW ADVANCED SECURITY SYSTEMS LTD., Or Yehuda (IL)

(72) Inventor: Amos Golan, Ramat Gan (IL)

(73) Assignee: SILVER SHADOW ADVANCED SECURITY SYSTEMS LTD., Or Yehuda (IL)

( * ) Notice: Subject to any disclaimer, the term of this patent is extended or adjusted under 35 U.S.C. 154(b) by 6 days.

(21) Appl. No.: 15/861,868

(22) Filed: Jan. 4, 2018

(65) Prior Publication Data

US 2018/0195824 A1 Jul. 12, 2018

(30) Foreign Application Priority Data

Jan. 10, 2017 (IL) ..... 250047

(51) Int. Cl.
*F41A 21/08* (2006.01)

(52) U.S. Cl.
CPC ..... *F41A 21/08* (2013.01)

(58) Field of Classification Search
CPC ..... F41A 21/06; F41A 21/08; F41A 35/00; F41F 1/08; F41C 27/00
See application file for complete search history.

(56) References Cited

U.S. PATENT DOCUMENTS 83,194 A * 10/1868 Maynard ..... F41A 21/06 42/76.01
1,285,253 A * 11/1918 Lepak ..... F41A 21/08 89/1.1
2,935,915 A * 5/1960 Janson ..... F41A 5/28 89/126
3,618,245 A * 11/1971 Pruonto ..... F41C 27/22 42/71.01
3,955,299 A * 5/1976 Bullis ..... F41G 1/52 42/106
4,094,086 A * 6/1978 Gevers ..... C21D 1/62 42/106

(Continued)

FOREIGN PATENT DOCUMENTS

DE 3415852 A1 * 10/1984 ..... F41A 21/08
DE 19538006 C1 * 4/1997 ..... F41A 21/08

(Continued)

*Primary Examiner* — Benjamin P Lee
(74) *Attorney, Agent, or Firm* — Dekel Patent Ltd.; David Klein

(57) ABSTRACT

A double barrel adjustment assembly includes first and second barrel receiving members, each of which is formed with a bore for passing therethrough a barrel of a weapon. The first and second barrel receiving members are formed with complementary surfaces. The double barrel adjustment assembly further includes rotatable first and second adjustment members. One end of the first adjustment member is rotatingly mounted in the second barrel receiving member and an opposite end of the first adjustment member is rotatingly mounted in the first barrel receiving member. One end of the second adjustment member is rotatingly mounted in the first barrel receiving member and an opposite end of the second adjustment member is rotatingly mounted in the second barrel receiving member.

14 Claims, 2 Drawing Sheets

(56) References Cited

U.S. PATENT DOCUMENTS

| | | | | | |
|---|---|---|---|---|---|
| 4,195,432 | A * | 4/1980 | Hickman | F41A 21/08 | 42/106 |
| 4,228,605 | A * | 10/1980 | Chacornac | F41A 21/08 | 42/106 |
| 7,467,490 | B2 * | 12/2008 | Mossberg | F41A 21/08 | 42/77 |
| 8,296,987 | B1 * | 10/2012 | Dlubak | F41A 21/08 | 42/75.01 |
| 8,935,873 | B2 * | 1/2015 | Moretti | F41A 21/08 | 42/40 |
| 9,227,250 | B2 * | 1/2016 | Stewart | B23B 35/00 | |
| 2006/0207154 | A1 * | 9/2006 | Lazor | F41A 21/06 | 42/76.01 |
| 2013/0174462 | A1 * | 7/2013 | Moretti | F41A 21/08 | 42/76.1 |
| 2015/0300772 | A1 * | 10/2015 | Carson | F41A 21/06 | 42/17 |
| 2017/0299290 | A1 * | 10/2017 | Beaty | F41A 3/60 | |

FOREIGN PATENT DOCUMENTS

| | | | | |
|---|---|---|---|---|
| DE | 102006041233 | A1 * | 3/2008 | F41A 21/08 |
| FR | 3017702 | A1 * | 8/2015 | F41A 21/08 |
| GB | 269976 | A * | 4/1927 | F41A 21/08 |

* cited by examiner

DOUBLE BARREL ADJUSTMENT ASSEMBLY

FIELD OF THE INVENTION

The present invention relates generally to firearms and particularly to a double barrel weapon with an adjustment assembly for adjusting angular (e.g., azimuth and elevation) orientation of the barrels.

BACKGROUND OF THE INVENTION

Firearms with more than one barrel are known, which have two bolts that each chambers a cartridge in the chamber of each barrel. Two firing pins simultaneously hit the primer on each cartridge to propel two bullets, one out of each barrel.

A problem with such double barrel weapons is a lack of an adjustment mechanism for adjusting the angular orientation of each barrel.

SUMMARY OF THE INVENTION

The present invention seeks to provide a novel double barrel weapon with an adjustment assembly for adjusting angular (e.g., azimuth and elevation) orientation of each of the barrels, as is described more in detail hereinbelow.

There is provided in accordance with a non-limiting embodiment of the invention, a double barrel adjustment assembly including first and second barrel receiving members, each of which is formed with a bore for passing therethrough a barrel of a weapon, wherein the first and second barrel receiving members are formed with complementary surfaces. The double barrel adjustment assembly further includes rotatable first and second adjustment members, wherein one end of the first adjustment member is rotatingly mounted in the second barrel receiving member and an opposite end of the first adjustment member is rotatingly mounted in the first barrel receiving member, and wherein one end of the second adjustment member is rotatingly mounted in the first barrel receiving member and an opposite end of the second adjustment member is rotatingly mounted in the second barrel receiving member.

The invention is applicable for any kind of double barrel weapon. Without limitation, for the sake of simplicity, the invention is described herein for a double-barrel, gas-operated, magazine-fed weapon that can use any kind of ammunition from two magazines. Upper and lower receivers are common to both barrels. There may be two separate bolts that are carried by a common bolt carrier or there may be individual bolt carriers. It is possible to fire from one barrel at a time or from both barrels.

Without limitation, the weapon can be embodied as a semi-automatic rifle, automatic rifle or a bolt action rifle, including assault rifles, sniper rifles with small or large caliber ammunition (e.g., 5.56 mm, .22 caliber, .338 caliber or 7.62×51 NATO, and many others), grenade launcher rifles, and many others. The magazines can be small or large capacity.

The double barrel adjustment assembly exploits the capability of the barrels to move relative to one another (by either slight elastic deformation or by the mounting position of the barrels being adjustable or elastically deformable).

The double barrel adjustment assembly is installed on the external surface of the barrels, and requires minor, if any, modification of the barrels external surfaces.

BRIEF DESCRIPTION OF THE DRAWINGS

The present invention will be understood and appreciated more fully from the following detailed description, taken in conjunction with the drawings in which.

DETAILED DESCRIPTION OF EMBODIMENTS

Figure 1B:
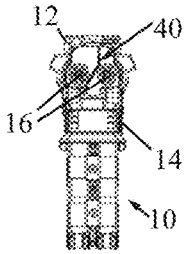
FIGS. 1A and 1B are simplified side and front view illustrations of a double barrel weapon, constructed and operative in accordance with a non-limiting embodiment of the present invention.
Figure 1A:
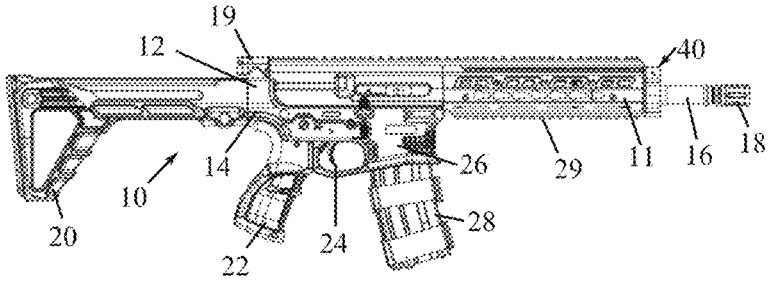

Reference is now made to FIGS. 1A-1B, which illustrate a weapon 10, constructed and operative in accordance with a non-limiting embodiment of the present invention. In the illustrated embodiment, weapon 10 is a gas-operated autoloading rifle with a rotating bolt-type action and magazine feed, having double bolts and double magazine feeds.

Figure 2:
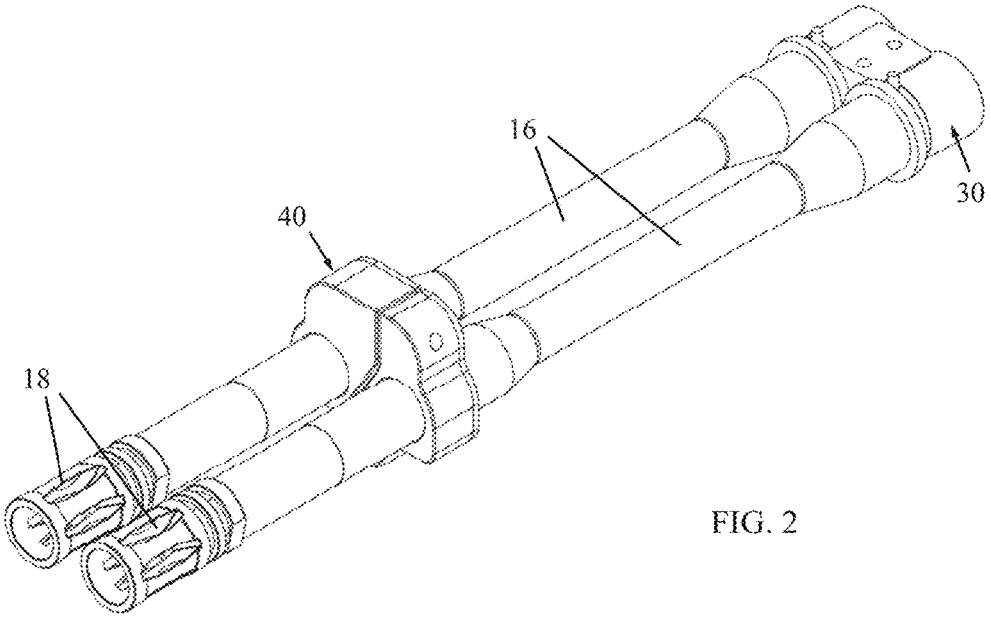
FIG. 2 is a simplified perspective illustration of a double barrel adjustment assembly mounted on the two barrels of the weapon of FIG. 1A, constructed and operative in accordance with a non-limiting embodiment of the present invention.

Weapon 10 includes an upper receiver 12 (e.g., pivotally) attached to a lower receiver 14 and having a pair of barrels 16 engaged in the upper receiver 12. The barrels 16 are secured by threaded connection to a double barrel extension 30, seen in FIG. 2 and described below with reference to FIGS. 4A-4B.

A handguard 11 (FIG. 1A) engages (e.g., by threaded engagement) the forward end of upper receiver 12. Each barrel 16 has a central rifled bore portion passing from the cartridge chamber area to the muzzle end of the barrel which is fitted with a flash suppressor 18.

In one embodiment, upper receiver 12 is an M-16/AR-15 type upper receiver, including among other things, a charging handle 19. Lower receiver 14 includes a butt 20, handgrip 22, trigger 24, and a double magazine well 26 (which could be a single structure with internal guides for each magazine) that removably receives a pair of self-feeding magazines 28 for holding a plurality of cartridges. Without limitation, the invention can be embodied as a semi-automatic rifle, automatic rifle or a bolt action rifle, including assault rifles, sniper rifles with small or large caliber ammunition (e.g., 5.56 mm, .22 caliber, .338 caliber or 7.62×51 NATO, and many others), grenade launcher rifles, and many others. Magazines 28 can be small or large capacity.

Lower receiver 14 may house a conventional firing mechanism and related components such as those used in M-16/AR-15 type rifles. As is well known, these firing mechanisms generally include a spring-biased hammer that is cocked and then released by a sear (all not shown) upon actuating trigger 24. There may be two hammers, each of which strikes a firing pin carried by a bolt, which is thrust forward to hit the primer of the cartridge (not shown).

In one embodiment, upper receiver 12 includes one or more accessory mounting rails 29, such as Picatinny or Weaver, for mounting accessories, such as but not limited to, scopes, grenade launchers, tactical flashlights, etc.

Reference is now made to FIGS. 2 and 3A-3F, which illustrate a double barrel adjustment assembly 40 mounted on the two barrels 16 (FIG. 2), constructed and operative in accordance with a non-limiting embodiment of the present invention.

As seen in FIGS. 3A-3F, double barrel adjustment assembly 40 includes first and second barrel receiving members 42 and 44. In the illustrated embodiment, the first and second barrel receiving members 42 and 44 are side-to-side because the barrels are side-to-side. However, alternatively, first and second barrel receiving members 42 and 44 may be arranged "over-and-under", that is, one on top of the other, for such weapons.

Figure 3A:
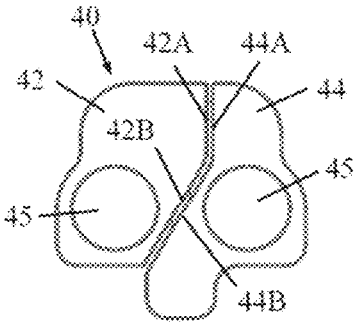
FIGS. 3A, 3B, 3C, 3D and 3E are simplified front-view, side-view, rear-view, sectional and internal rear-view illustrations, respectively, of the double barrel adjustment assembly, with FIG. 3D taken along lines D-D in FIG. 3E.
Figure 3B:
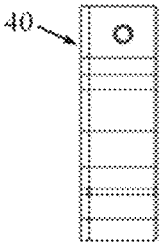
Figure 3C:
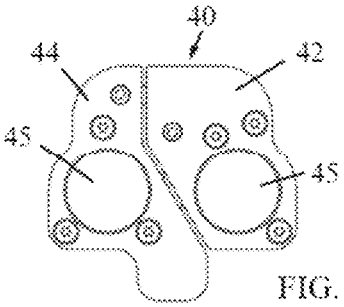

Each of first and second barrel receiving members 42 and 44 is formed with a bore 45, through which the barrel passes. The first and second barrel receiving members 42 and 44 are formed with complementary surfaces 42A and 44A and 42B and 44B, respectively (FIG. 3A). The complementary surfaces may extend from one another, and may be straight or alternatively may be curved. The complementary surfaces 42A and 44A may be vertical, whereas the complementary surfaces 42B and 44B may be slanted (tilted from the vertical).

The double barrel adjustment assembly 40 includes rotatable first and second adjustment members 46 and 48, respectively. As seen in FIG. 3E, one end of first adjustment member 46 includes a rotating nut 46A rotatingly mounted in second barrel receiving member 44, and the opposite end of first adjustment member 46 includes a serrated spherical screw 46B rotatingly mounted in first barrel receiving member 42. Conversely, one end of second adjustment member 48 includes a rotating nut 48A rotatingly mounted in first barrel receiving member 42, and the opposite end of second adjustment member 48 includes a serrated spherical screw 48B rotatingly mounted in second barrel receiving member 44.

Figure 3D:
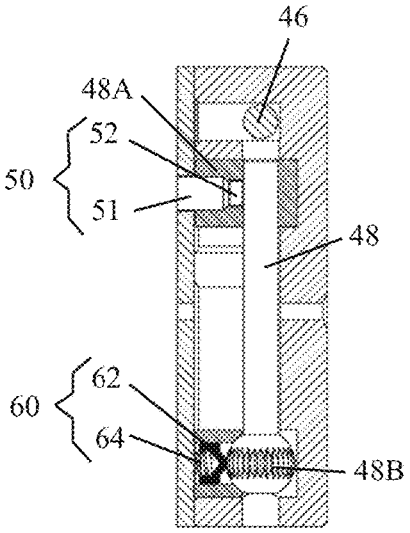
Figure 3E:
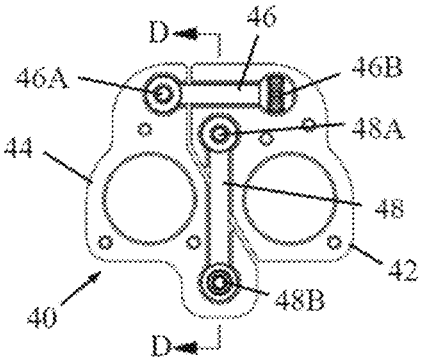

As seen in FIG. 3D, a locking plunger assembly 50 and a clicking plunger assembly 60 are provided for each adjustment member (46 or 48). FIG. 3D shows the plunger assemblies for adjustment member 48, but the same holds true for adjustment member 46.

The locking plunger assembly 50 includes a set screw 51 arranged to move through an opening in rotating nut 48A and press a bar 52 (such as a flat brass bar) against the shaft of adjustment member 48. Once bar 52 is pressed against the shaft of adjustment member 48, the adjustment member 48 is locked in place. Thus, locking plunger assembly 50 is used to lock the adjustment member in place after the adjustment member has been turned to adjust the angular orientation of the barrel.

The clicking plunger assembly 60 includes a plunger pin 62 and a plunger biasing device (e.g., compression spring) 64. The plunger pin 62 is urged by plunger biasing device 64 against serrated spherical screw (46B or 48B), which creates an audible "clicking" sound during the adjustment of the first and second adjustment members 46 and 48, so the user can feel/hear how many "clicks" the adjustment members have been turned. The invention can be carried out without the "audible" plunger assemblies 60.

First adjustment member 46 adjusts the angular orientation of first and second barrel receiving members 42 and 44 in azimuth. Rotation of the rotating nut 46A of first adjustment member 46 either makes the first and second barrel receiving members 42 and 44 point more towards each other or further away from each other.

Second adjustment member 48 adjusts the angular orientation of first and second barrel receiving members 42 and 44 in elevation. Rotation of the rotating nut 48A of second adjustment member 48 makes the first and second barrel receiving members 42 and 44 move with respect to each other along surfaces 42A and 44A and 42B and 44B. The gaps between surfaces 42A and 44A and 42B and 44B allow the first and second barrel receiving members 42 and 44 to move with respect to each other. Thus, rotation of second adjustment member 48 makes one of the first and second barrel receiving members 42 and 44 point more upwards and the other one point more downwards.

The spherical shape of the serrated spherical screw (46B or 48B) allows the adjustment member 46 or 48 to tilt off horizontal or vertical during relative movement between first and second barrel receiving members 42 and 44.

The double barrel adjustment assembly 40 may be integrated together with the gas blocks and/or piston assembly of the weapon, depending on the weapon.

Figure 4A:
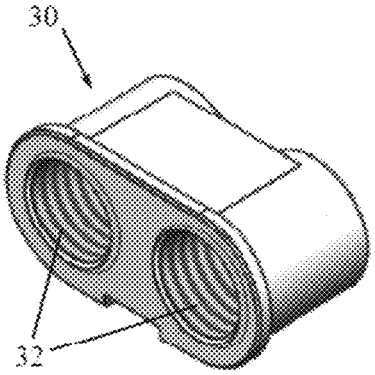
FIGS. 4A and 4B are simplified perspective illustrations of a double barrel extension, in which one side is used for threaded connection of the barrels and the other side is used for locking the bolts of the bolt carriers.
Figure 4B:
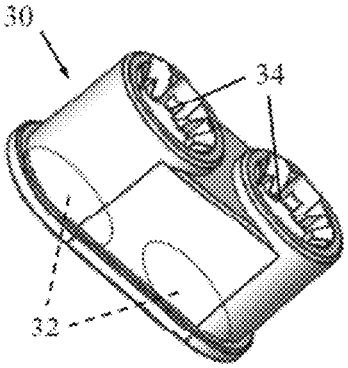

Reference is now made to FIGS. 4A and 4B, which illustrate a double barrel extension 30. The double barrel extension 30 includes a pair of internally threaded bores 32 which are used for threaded connection of the barrels. The opposite side of each of the bores is formed with conical grooves 34 for locking the bolt lugs of the bolt (not shown) for each of the barrels.

The double barrel extension 30 may be machined or otherwise formed from a unitary piece. Alternatively, double barrel extension 30 may be made of two pieces welded or otherwise joined together.

What is claimed is:

1. An accessory for a weapon having double barrels, the accessory comprising:

a double barrel adjustment assembly comprising first and second barrel receiving members, each of which is formed with a bore for passing therethrough a barrel of a weapon;

said double barrel adjustment assembly further comprising rotatable first and second adjustment members, wherein one end of said first adjustment member is rotatingly mounted in said second barrel receiving member and an opposite end of said first adjustment member is rotatingly mounted in said first barrel receiving member, and wherein one end of said second adjustment member is rotatingly mounted in said first barrel receiving member and an opposite end of said second adjustment member is rotatingly mounted in said second barrel receiving member;

wherein said first and second barrel receiving members are formed with complementary-shaped surfaces one of which is vertical and another of which is slanted and tilted from the vertical, and said complementary-shaped surfaces slide relative to each other from one operative position to another operative position.

2. The accessory according to claim 1, wherein said one end of said first adjustment member comprises a rotating nut rotatingly mounted in said second barrel receiving member.

3. The accessory according to claim 1, wherein said one end of said second adjustment member comprises a rotating nut rotatingly mounted in said first barrel receiving member.

4. The accessory according to claim 1, wherein said opposite end of said first adjustment member comprises a serrated spherical screw rotatingly mounted in said first barrel receiving member.

5. The accessory according to claim 1, wherein said opposite end of said second adjustment member comprises a serrated spherical screw rotatingly mounted in said second barrel receiving member.

6. The accessory according to claim 1, wherein each of said first and second adjustment members comprises at least one plunger assembly.

7. The accessory according to claim 6, wherein said plunger assembly comprises a locking plunger assembly comprising a set screw arranged to move through an opening in a rotating nut and press a bar against said adjustment member.

8. The accessory according to claim 1, wherein said first adjustment member is operative to adjust an angular orientation of said first and second barrel receiving members in azimuth.

9. The accessory according to claim 1, wherein said second adjustment member is operative to adjust an angular orientation of said first and second barrel receiving members in elevation.

10. The accessory according to claim 1, further comprising a double barrel extension formed with a pair of internally threaded bores for threaded connection of the barrels, wherein an opposite side of each of said internally threaded bores is formed with conical grooves for locking bolt lugs of a bolt for each of the barrels.

11. A weapon comprising:

an upper receiver, a lower receiver attached to said upper receiver, said lower receiver comprising a trigger, and a magazine well for removably receiving a pair of self-feeding magazines, and a pair of barrels;

a double barrel adjustment assembly comprising first and second barrel receiving members, each of which is formed with a bore for passing therethrough one of the barrels;

said double barrel adjustment assembly further comprising rotatable first and second adjustment members, wherein one end of said first adjustment member is rotatingly mounted in said second barrel receiving member and an opposite end of said first adjustment member is rotatingly mounted in said first barrel receiving member, and wherein one end of said second adjustment member is rotatingly mounted in said first barrel receiving member and an opposite end of said second adjustment member is rotatingly mounted in said second barrel receiving member;

wherein said first and second barrel receiving members are formed with complementary-shaped surfaces one of which is vertical and another of which is slanted and tilted from the vertical, and said complementary-shaped surfaces slide relative to each other from one operative position to another operative position.

12. The weapon according to claim 11, further comprising a double barrel extension formed with a pair of internally threaded bores that are in threaded connection with the barrels, wherein an opposite side of each of said internally threaded bores is formed with conical grooves for locking bolt lugs of a bolt for each of the barrels.

13. The weapon according to claim 11, wherein said first adjustment member is operative to adjust an angular orientation of said first and second barrel receiving members in azimuth.

14. The weapon according to claim 11, wherein said second adjustment member is operative to adjust an angular orientation of said first and second barrel receiving members in elevation.

* * * * *